US008272933B2

(12) United States Patent
Nardizzi et al.

(10) Patent No.: US 8,272,933 B2
(45) Date of Patent: Sep. 25, 2012

(54) SYSTEM AND METHOD OF INCREASING POKER TOURNAMENT POOLS AND NUMBER OF PAYOUT POSITIONS

(75) Inventors: Robert V. Nardizzi, Las Vegas, NV (US); Robert J. Miller, Las Vegas, NV (US)

(73) Assignee: Bubbleproof Me, LLC, Las Vegas, NV (US)

( * ) Notice: Subject to any disclaimer, the term of this patent is extended or adjusted under 35 U.S.C. 154(b) by 511 days.

(21) Appl. No.: 12/410,690

(22) Filed: Mar. 25, 2009

(65) Prior Publication Data

US 2010/0120519 A1 May 13, 2010

Related U.S. Application Data

(60) Provisional application No. 61/113,215, filed on Nov. 10, 2008.

(51) Int. Cl.
*A63F 9/24* (2006.01)

(52) U.S. Cl. ..... 463/13

(58) Field of Classification Search ..... 463/13, 463/26, 27; 273/274, 292
See application file for complete search history.

(56) References Cited

U.S. PATENT DOCUMENTS 6,334,614 B1 * 1/2002 Breeding ..... 273/292
2006/0211473 A1 * 9/2006 Walker et al. ..... 463/16

OTHER PUBLICATIONS

Rosales, Rebecca, "Hollywood Poker Offering Bubble Insurance", www. internetpoker.com/Poker-News/Poker-Sites/Hollywood-Poker, Jul. 15, 2008, 1 page.

* cited by examiner

*Primary Examiner* — Brook Kebede
(74) *Attorney, Agent, or Firm* — Greenberg Traurig

(57) ABSTRACT

A second optional poker tournament fee allows participating players a chance to receive a payout when finishing the poker tournament in one of one or more extra bubble spots. So, if the player finishes close to the conventional bubble position the player may receive a payout if he or she paid the second optional fee. The number of extra spots is based on the number of second optional fees paid. In one version, if no players finish in the extra bubble spots the house collects the second optional fees as profits. In another version, the second optional fees, or a portion thereof, are used to increase the payouts associated with the conventional payout scheme independent of the second optional fees.

20 Claims, 6 Drawing Sheets

102

| 136 | 141 | 146 | 151 | 156 | 161 |
|---|---|---|---|---|---|
| Extra Fee | Extra Tournament Fee | Bubble Funds | Extra House Revenue | Bubble Spot Payouts | Extra/Total Places Paid |
| $30 | $35,100 | $24,570 | $10,530 | $1,000 | 10/127 |

Fig. 2b

103

| 137 Extra Fee | 142 Extra Tournament Fee | 147 Bubble Funds | 152 Extra House Revenue | 157 Bubble Spot Payouts | 162 Extra/Total Places Paid |
|---|---|---|---|---|---|
| $20 | $23,400 | $16,380 | $7,020 | $1,000 | 7/124 |

Fig. 2c

SYSTEM AND METHOD OF INCREASING POKER TOURNAMENT POOLS AND NUMBER OF PAYOUT POSITIONS

CROSS REFERENCE TO RELATED APPLICATIONS

This application claims the benefit of U.S. Provisional Application No. 61/113,215 filed Nov. 10, 2008.

FIELD OF THE INVENTION

The embodiments of the present invention relate to a system and method of increasing poker tournament pools and a number of payouts with a focus on providing a larger number of bubble payouts.

BACKGROUND

With television coverage, poker has become extremely popular. Accordingly, poker games attract larger player pools and prize monies. Poker tournaments have seen dramatic increases in the number of entrants and prize pools. In a typical poker tournament the top 10% of the entrants receive a payout. For example, if 100 players enter a poker tournament, the final 10 players will receive a payout. Using the same example, the players that finish in $11^{th}$ to $15^{th}$ are said to be on the bubble (i.e., close to the money but not quite). In many circumstances, especially with large fields and long tournaments, players prefer to be knocked out early rather than finish in a bubble position.

Thus, it would be advantageous to provide players with an opportunity to receive a payout when finishing near a bubble position but in a position not normally paid.

SUMMARY

Accordingly, a first embodiment of the present invention is a method of conducting a poker tournament comprising: accepting a poker tournament entry fee; determining a payout scheme based on a number of poker tournament entry fees accepted, said payout scheme including a first number of finishing spots to be paid; accepting second optional fees from players; tracking each player placing the second optional fee; adding one or more extra finishing spots to the first number of finishing spots to be paid based on a number of second optional fees accepted; and limiting extra finishing spot payouts to players paying said second optional fee.

Another embodiment of the present invention is a method of conducting a poker game comprising: accepting a poker tournament entry fee; determining a payout scheme based on a number of poker tournament entry fees accepted, said payout scheme including a first number of finishing spots to be paid; accepting second optional fees from players; providing players paying said second optional fees with proof of payment; adding one or more extra finishing spots to the first number of finishing spots to be paid based on a number of second optional fees accepted; displaying said first number of finishing spots, extra finishing spots and corresponding payouts whereby extra finishing spot payouts are limited to players paying said second optional fee.

Another embodiment of the present invention is an electronic poker system configured for play over a computer network accessible by player terminals, said terminals including at least a display and user interface, comprising: computer means programmed to: accept poker tournament entry fees; determine a payout scheme based on a number of accepted poker tournament entry fees, said payout scheme including a number of finishing spots to be paid; accept a second optional fee from players; track each player placing the second optional fee; adding one or more extra spots to the number of finishing spots to be paid based on a number of second optional fees accepted; and limit payouts corresponding to said extra spots to players placing said second optional fee.

With the embodiments of the present invention, players may pay an optional fee that provides a payout should the player finish the tournament in one of one or more extra bubble spots added to the number of finishing spots to be paid. So, if the player finishes close to the conventional bubble position the player may receive a payout if he or she paid the second optional fee. The number of extra spots is based on the number of second optional fees paid. In one embodiment, if no players finish in the extra spots the house collects the second optional fees as profits. In another embodiment, the second optional fees, or a portion thereof, are used to increase the payouts associated with the conventional payout scheme independent of the second optional fees.

Other variations, embodiments and features of the present invention will become evident from the following detailed description, drawings and claims.

BRIEF DESCRIPTION OF THE DRAWINGS

FIGS. 2*a*-2*c* illustrate modified payout schemes for the poker tournament of FIG. 1 according to a first embodiment of the present invention.

DETAILED DESCRIPTION

Figure 1:
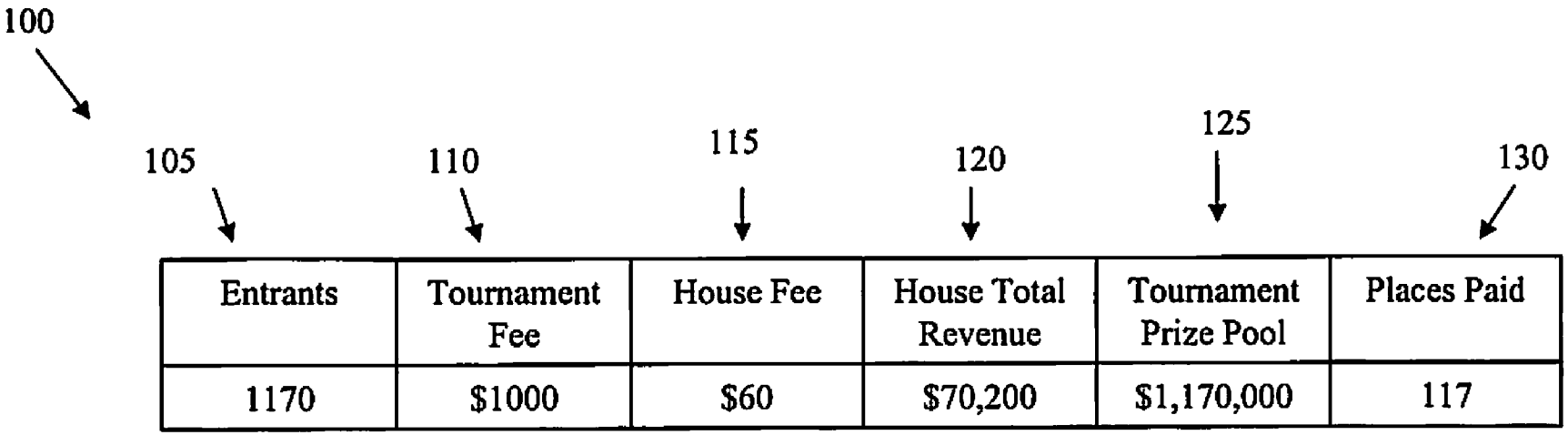
FIG. 1 illustrates a conventional payout scheme for a poker tournament.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention are ideal for poker tournaments and the disclosure below focuses on poker. However, those skilled in the art will recognize that other tournament games may benefit from the embodiments as well.

FIG. 1 shows a conventional payout scheme 100 for a conventional poker tournament. The payout scheme is based on 1170 entrants 105 each paying $1000 tournament entry fee 110 plus a $60 house fee 115 creating a total prize pool of $1,170,000 (1170×$1000) 120. The house collects $70,200 (1170×$60) as its fee 125. The house may also take a percentage (e.g., 2%-10%) of each entry fee for conducting the poker tournament rather than the additional fee on top of the entry fee. In this example, as shown, the top 117 places 130 are paid. Normally first place is paid 50% of the prize pool while the remaining 116 players share the other 50%. The term "on the bubble" is the final spot immediately preceding the start of payouts. In this example, the player finishing in the $118^{th}$ spot is said to finish on the bubble. More generally, the term bubble means any spot near the first payout spot. With the top 117 spots being paid, spots 118-125 (or any other suitable range) may be considered bubble spots (i.e., spots close to making the money but receiving nothing).

Figure 2A:
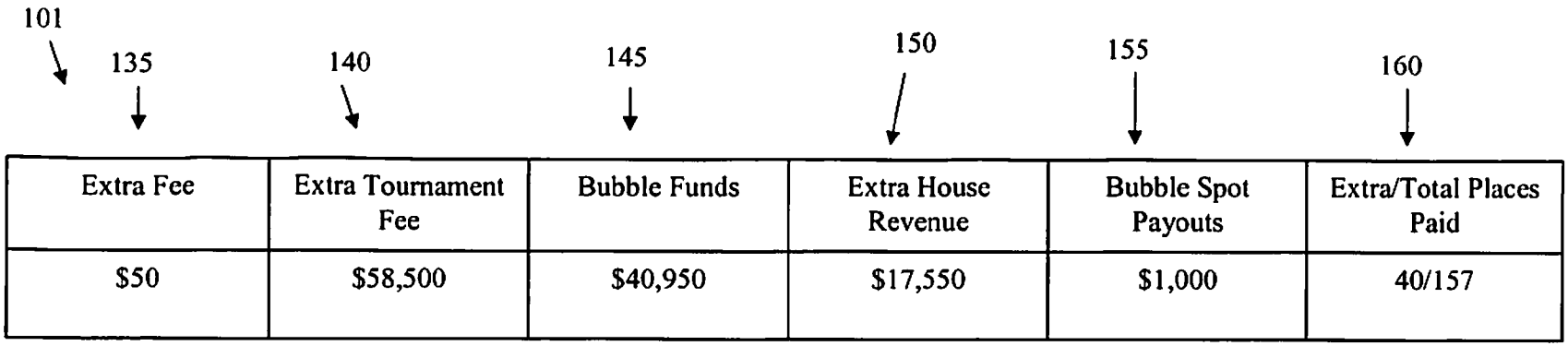

The embodiments of the present invention expand payouts to bubble spots for those entrants paying a second optional or extra fee in addition to the conventional poker tournament entry fee. In one embodiment, the extra fee (aka Hedge Bet) is 5% of the entry fee. Those skilled in the art will recognize that any percentage (1%-20% or more) of the entry fee or fixed fee may be used to establish the extra fee and is within the spirit and scope of the present invention. FIG. 2*a* shows a chart 101 with a 5% second optional or extra fee 135 based on the $1000 entry fee 110. FIG. 2*a* assumes that all entrants elect to pay the second optional fee 135 generating $58,500 (1170×$50) 140. In one embodiment, 70% of the collected second optional fees 135 are used to fund payouts for additional bubble spots. In this instance, a pool of $40,950 (70%× $58,500) 145 is generated and $17,550 (30%×$58,500) 150 is collected by the house. The $40,950 can be used to fund the payouts for the additional bubble spots. In one embodiment, the payouts for the additional bubble spots are each equal to the $1000 entry fee. So, in this instance, the $40,950 allows an additional 40 bubble spots to be paid $1000. Thus, a total of 157 spots (117 conventional+40 additional bubble spots) are paid. The extra $950 may be used to provide another bubble spot payout, may be collected as revenue or used as the operator desires. In other embodiments, the payouts for additional bubble spots may be increased and the number of additional bubble spots may be decreased. For example, in this instance an additional 20 bubble spots may each be paid $2000. Those skilled in the art will recognize that any conceivable manipulation of payouts and additional bubble spots may be utilized according to the embodiments of the present invention. In this example, each player finishing in one of the 40 bubble spots will receive a payout since each entrant paid the second optional fee. Besides providing players with an opportunity to receive a return when finishing in a bubble spot, the second optional fees also provide the house with additional revenue. The $18,500, when added to the $70,200 house hold, is a 26% increase for the house from the identical poker tournament. FIGS. 2*b* and 2*c* show charts 102, 103 listing extra fees of 3% and 2%, respectively, of the poker tournament fees. Charts 102, 103 have the same entry fee of $1000 and the same number of entrants 1170 as set forth in charts 100, 101. As listed in chart 102 of FIG. 2*b*, $30 is the extra fee 136, $35,100 is the extra tournament fee total 141, $24,570 (70%×$35,100) is allocated to bubble funds 146, $10,530 (30%×$35,100) is allocated as house revenue 151, $1000 is used to pay bubble spots 156 and 10 extra bubble payout spots 161 are created. As listed in chart 103 of FIG. 2*c*, $20 is the extra fee 137, $23,400 is the extra tournament fee total 142, $16,380 (70%×$23,400) is allocated to bubble finds 147, $7,020 (30%×$23,400) is allocated as house revenue 152, $1000 is used to pay bubble spots 157 and 7 extra bubble payout spots 162 are created.

It is unlikely that all players entering a tournament will pay the second optional fee. Thus, there will be situations where no player paying the second optional fee will finish in the additional bubble spots. In such instances, the house collects 100% of the second optional fees. That is, the payouts associated with the additional bubble spots can only be won by players paying the second optional fee prior to the tournament starting. Alternatively, the house may elect to hold only a percentage of the second optional fees and enhance the conventional fees using the remaining percentage of the second optional fees.

Figure 3:
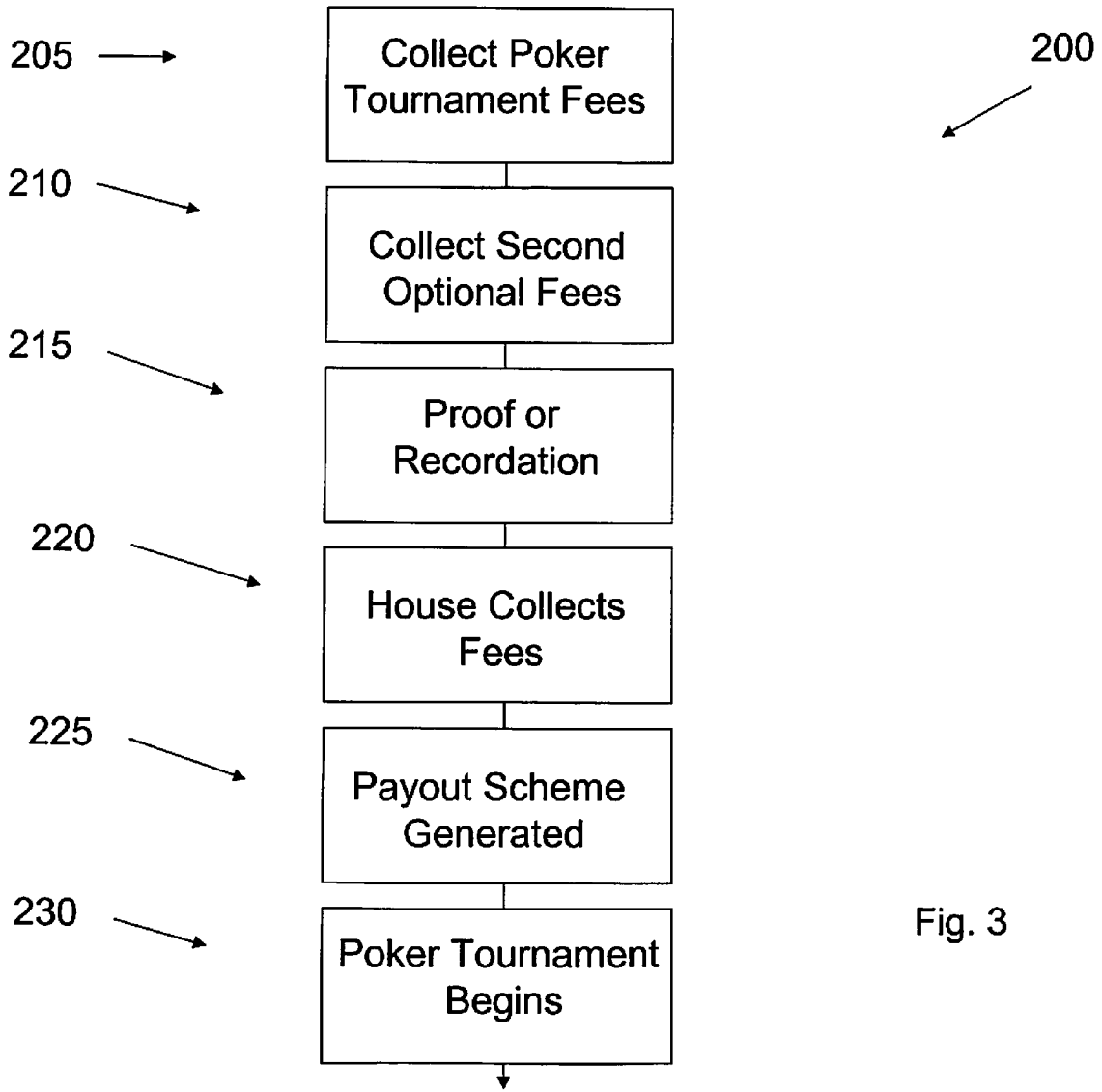
FIG. 3 illustrates a flow chart detailing a method of conducting a poker tournament according to a first embodiment of the present invention.
Figure 3:
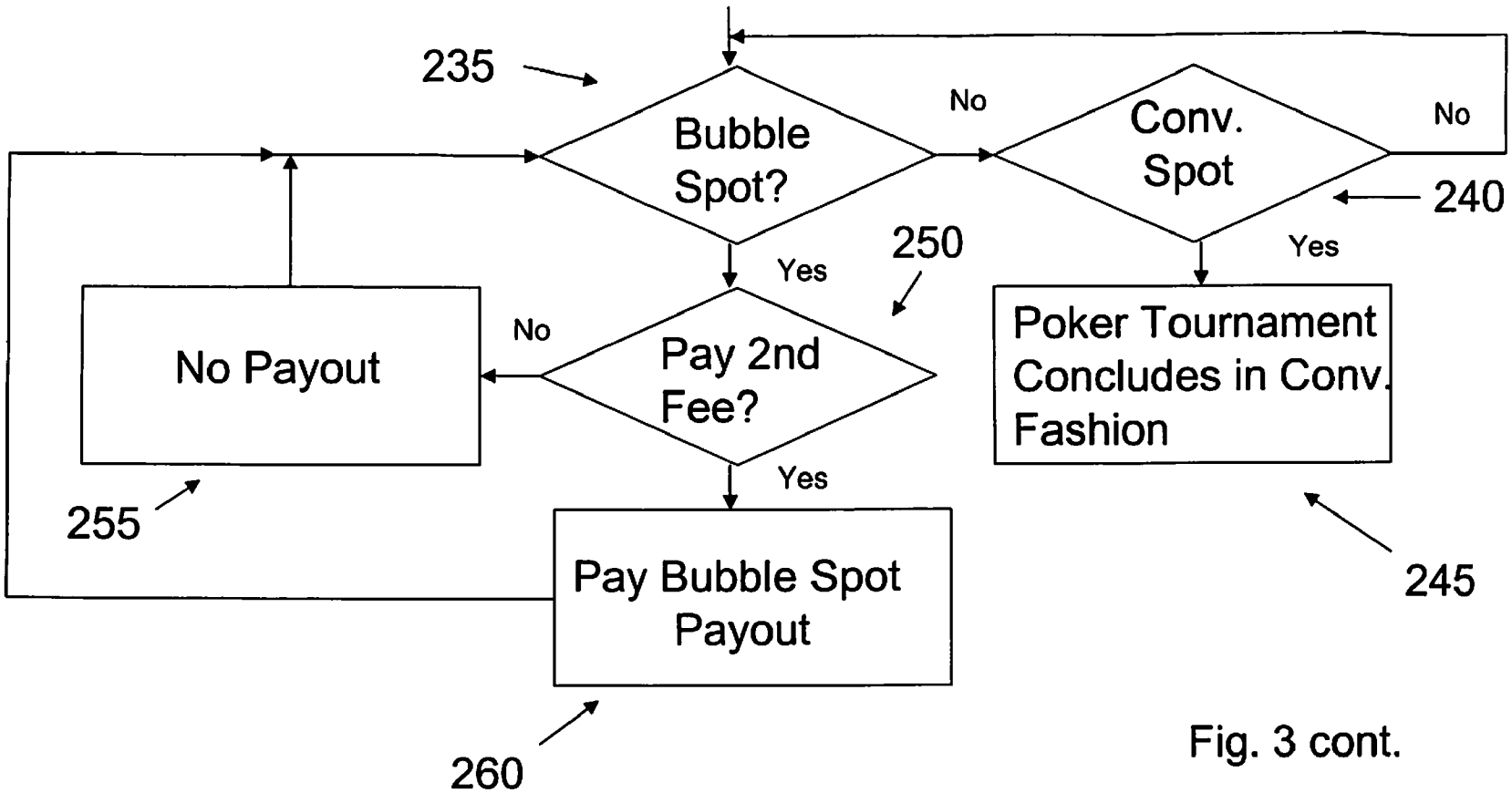

FIG. 3 shows a flow chart 200 detailing a method of conducting a poker tournament according to the embodiments of the present invention. At 205, poker tournament entry fees are collected. At 210, second optional fees are collected. At 215, players paying the second optional fee are provided proof of payment or the house records the payment. Proof may comprise a special token, receipt, voucher or similar tangible item which allows the house confirm the player paid the second optional fee in the event the player finishes in one of the additional bubble spots. At 220, the house collects its percentage of the poker tournament fees and second optional fees. At 225, a payout scheme is generated using the poker tournament fees (e.g., spots equal to 10% of total entrants paid) along with payouts for additional bubble spots based on the second optional fees. At 230, the poker tournament begins. At 235, it is determined whether the player being eliminated from the tournament is at a level associated with the one or more additional bubble spots. If not, at 240, it is determined whether the conventional payout spots have been reached. If the conventional payout spots have been reached, the chart advances to step 245 where the poker tournament concludes in a conventional fashion with each eliminated player receiving a conventional payout according to the payout scheme. If, at 240, the conventional payout spots have not been reached, the chart 200 loops back to step 235. If, at 235, it is determined the player is at a bubble spot, at 250, it is determined whether the player paid the second optional fee. If not, at 255, the player receives no payout and the chart loops back to step 235. If the player did pay the second optional fee, at 260, the player receives a payout associated with the specific bubble spot finish.

In a poker room setting, it is likely that the embodiments of the present invention will be facilitated by software. Poker rooms currently use commercially available software to manage conventional poker tournaments. The commercial software maintains number of entrants, prize pool, payout spots and payout amounts (after the house takes it portion). The software interacts with one or more displays in the poker room wherein said displays depict tournament levels, number of players remaining, average chip stacks, etc. Accordingly, in one embodiment of the present invention the software is developed to integrate with the commercial software. Alternatively, the software according to the embodiments of the present invention may be completely separate. In either instance, based on user customization, the software according to the embodiments of the present invention automatically tracks the number of second optional fees paid and the pool generated thereby. Then, based on further user customization, generates a number of additional bubble spots and corresponding payouts. This information may be displayed on the current displays in conjunction with the other tournament information referenced above.

With an online embodiment, the second option fee is made available for players signing up to play poker tournaments and the Internet server running appropriate software manages the additional bubble spots, corresponding payouts and the like. Indeed, all facets of the live game may be implemented in online embodiments.

Those skilled in the art will recognize that the amount of the second optional fees, number of additional bubble spots, payouts associated with a player paying the second optional fee and finishing in an added bubble spot and the like may be modified and optimized as deemed appropriate by the operator offering the same.

Although the invention has been described in detail with reference to several embodiments, additional variations and modifications exist within the scope and spirit of the invention as described and defined in the following claims.

We claim:

1. A method of conducting a poker tournament comprising:

accepting a poker tournament entry fee from multiple players;

determining a payout scheme based on a number of poker tournament entry fees accepted, said payout scheme including a first number of finishing spots to be paid and funded with said poker tournament entry fees, said first number of finishing spots less than a total number of players paying said entry fee;

accepting second optional fees from players;

tracking each player paying the second optional fee;

adding one or more extra finishing spots to the first number of finishing spots to be paid wherein a sum of said first number of finishing spots and said extra finishing spots is less than a total number of players paying said entry fee, a number of extra finishing spots being based on a number of second optional fees accepted;

determining potential payouts for said extra finishing spots based on the number of second optional fees paid; and paying extra finishing spot payouts to players paying said second optional fee and finishing said poker tournament in one of said extra finishing spots, said extra finishing spot payouts funded by said second optional fees.

2. The method of claim 1 further comprising a poker tournament operator collecting a percentage of said second optional fees as compensation for conducting the poker tournament.

3. The method of claim 1 further comprising a poker tournament operator collecting all second optional fees when no player paying said second optional fees finishes the poker tournament in one or more of said extra finishing spots.

4. The method of claim 1 further comprising establishing the second optional fee in a range of 1% to 20% of the poker tournament entry fee.

5. The method of claim 1 further comprising establishing said extra finishing spot payouts equivalent to said poker tournament entry fee.

6. The method of claim 1 further comprising utilizing at least a portion of said second optional fees to enhance payouts associated with said first number of finishing spots to be paid.

7. The method of claim 1 facilitated by a computer network.

8. A method of conducting a poker tournament comprising:

accepting a poker tournament entry fee from multiple players;

determining a payout scheme based on a number of poker tournament entry fees accepted, said payout scheme including a first number of finishing spots to be paid and funded with said poker tournament entry fees, said first number of finishing spots less than a total number of players paying said entry fee;

accepting second optional fees from players;

providing players paying said second optional fees with proof of payment;

adding one or more extra finishing spots to the first number of finishing spots to be paid wherein a sum of said first number of finishing spots and said extra finishing spots is less than a total number of players paying said entry fee, a number of extra finishing spots being based on a number of second optional fees accepted;

determining potential payouts for said extra finishing spots based on the number of second optional fees paid;

displaying said first number of finishing spots, extra finishing spots and corresponding payouts; and paying extra finishing spot payouts to players paying said second optional fee and finishing said poker tournament in one of said extra finishing spots, said extra finishing spot payouts funded by said second optional fees.

9. The method of claim 8 further comprising a poker tournament operator collecting a percentage of said second optional fees as compensation for conducting the poker tournament.

10. The method of claim 8 further comprising a poker tournament operator collecting all second optional fees when no player paying said second optional fees finishes the poker tournament in one or more of said extra finishing spots.

11. The method of claim 8 further comprising establishing the second optional fee in a range of 1% to 20% of the poker tournament entry fee.

12. The method of claim 8 further comprising establishing said extra finishing spot payouts equivalent to said poker tournament entry fee.

13. The method of claim 8 further comprising utilizing at least a portion of said second optional fees to enhance payouts associated with said first number of finishing spots to be paid.

14. The method of claim 8 facilitated by a computer network.

15. An electronic poker system configured for play over a computer network accessible by player terminals, said terminals including at least a display and user interface, comprising:

computer means programmed to:

accept poker tournament entry fees from multiple players;

determine a payout scheme based on a number of accepted poker tournament entry fees, said payout scheme including a number of finishing spots to be paid and funded with said poker tournament entry fees, said first number of finishing spots less than a total number of players paying said entry fee;

accept a second optional fee from players;

track each player paying the second optional fee;

add one or more extra spots to the number of finishing spots to be paid wherein a sum of said first number of finishing spots and said extra finishing spots is less than a total number of players paying said entry fee, a number of extra finishing spots being based on a number of second optional fees accepted;

determine potential payouts for said extra finishing spots based on the number of second optional fees paid; and pay payouts corresponding to said extra spots to players paying said second optional fee and finishing said poker tournament in one of said extra finishing spots, said extra finishing spot payouts funded by said second optional fees.

16. The system of claim 15 wherein said computer means is further programmed to apportion a percentage of said second optional fees to a poker tournament operator as compensation for conducting the poker tournament.

17. The system of claim 15 wherein said computer means is further programmed to apportion 100% of said second optional fees to a poker tournament operator as compensation for conducting the poker tournament when no player paying said second optional fees finishes the poker tournament in one or more of said extra finishing spots.

18. The system of claim 15 wherein said computer means is further programmed to establish the second optional fee in a range of 1% to 20% of the poker tournament entry fee.

19. The system of claim 15 wherein said computer means is further programmed to establish said extra finishing spot payouts equivalent to said poker tournament entry fee.

20. The system of claim 15 wherein said computer means is further programmed to apportion at least a portion of said second optional fees to enhance payouts associated with said first number of finishing spots to be paid.

* * * * *